US011127240B2

(12) United States Patent
Deaton et al.

(10) Patent No.: US 11,127,240 B2
(45) Date of Patent: Sep. 21, 2021

(54) VENDING MACHINE

(71) Applicant: Jukka, Inc., Chicago, IL (US)

(72) Inventors: James Edward Deaton, Georgetown, TX (US); Linda H. Wu, Newberg, OR (US); John C. Serieka, Chicago, IL (US); Lynn Warren Hamrick, Leander, TX (US)

(73) Assignee: JUKKA, INC., Chicago, IL (US)

( * ) Notice: Subject to any disclaimer, the term of this patent is extended or adjusted under 35 U.S.C. 154(b) by 0 days.

(21) Appl. No.: 16/965,112

(22) PCT Filed: Jan. 31, 2019

(86) PCT No.: PCT/US2019/015945

§ 371 (c)(1),
(2) Date: Jul. 27, 2020

(87) PCT Pub. No.: WO2019/152580

PCT Pub. Date: Aug. 8, 2019

(65) Prior Publication Data

US 2020/0364968 A1 Nov. 19, 2020

Related U.S. Application Data

(60) Provisional application No. 62/625,559, filed on Feb. 2, 2018.

(51) Int. Cl.

| | |
|---|---|
| ***G07F 11/70*** | (2006.01) |
| ***G07F 9/10*** | (2006.01) |
| ***G07F 11/54*** | (2006.01) |

(52) U.S. Cl.

CPC ..... *G07F 11/70* (2013.01); *G07F 9/10* (2013.01); *G07F 11/54* (2013.01)

(58) Field of Classification Search

CPC .... G07F 11/165; G07F 17/0078; G07F 11/70; G07F 11/54; G07F 9/10; G07F 9/105

(Continued)

(56) References Cited

U.S. PATENT DOCUMENTS 3,397,817 A 8/1968 Smith
4,671,425 A * 6/1987 Knoll ..... G07F 9/10 221/122

(Continued)

FOREIGN PATENT DOCUMENTS

EP 0375884 7/1990

OTHER PUBLICATIONS

International Search Report filed in PCT/US/ dated Apr. 26, 2019.

*Primary Examiner* — Timothy R Waggoner
(74) *Attorney, Agent, or Firm* — Rankin, Hill & Clark LLP

(57) ABSTRACT

A vending machine includes a main unit, and a secondary unit separate from and operably connected to the main unit. The secondary unit includes a refrigerated enclosure for housing pre-packaged food products and an oven for selectively cooking the pre-packaged food products. The main unit includes a transfer mechanism adapted to selectively remove one of the pre-packed food products from the enclosure and transfer the one pre-packaged food product to the oven for cooking. The transfer mechanism is further adapted to remove the cooked one pre-packaged food product from the oven and transfer the cooked one pre-packaged food product to a customer receiving area provided in the main unit.

18 Claims, 6 Drawing Sheets

(58) Field of Classification Search
USPC ..... 221/150 A, 150 R, 150 HC
See application file for complete search history.

(56) References Cited

U.S. PATENT DOCUMENTS

| | | | | |
|---|---|---|---|---|
| 4,687,119 | A * | 8/1987 | Juillet | G07F 9/105 221/101 |
| 4,872,541 | A | 10/1989 | Hayashi | |
| 5,240,139 | A | 8/1993 | Chirnomas | |
| 5,503,300 | A | 4/1996 | Prescott | |
| 6,059,142 | A | 5/2000 | Wittern, Jr. et al. | |
| 6,276,602 | B1 | 8/2001 | Henderson et al. | |
| 8,651,324 | B2 * | 2/2014 | Borghi | G07F 11/54 221/150 HC |
| 2001/0002674 | A1 | 6/2001 | Gubbini | |
| 2004/0216390 | A1 * | 11/2004 | Healy | A47F 5/0853 52/27 |
| 2006/0042193 | A1 | 3/2006 | Elustondo | |
| 2006/0191914 | A1 | 8/2006 | Guindulain Vidondo | |
| 2006/0196883 | A1 * | 9/2006 | Ward | G07F 17/0078 221/2 |
| 2008/0163762 | A1 | 7/2008 | Weiss | |
| 2009/0076650 | A1 * | 3/2009 | Faes | G07F 11/165 700/232 |
| 2009/0120761 | A1 * | 5/2009 | Bashor | G07F 9/105 194/350 |
| 2014/0172159 | A1 | 6/2014 | Unmussig et al. | |
| 2017/0206733 | A1 | 7/2017 | Yu | |

* cited by examiner

VENDING MACHINE

BACKGROUND

Automatic food dispensers or vending machines for dispensing pre-packaged food products are well known. Typically, the vending machine includes a cabinet or housing having mounted therein at least one refrigerated enclosure that includes passages or compartments for storing pre-packaged food products to be dispensed. The vending machine can further be provided with an oven and a conveying system operable to remove one of the food products from the refrigerated enclosure and position the food product within the oven for heating/cooking. It is known to link multiple vending machines and to control the multiple vending machines with a single controller. Typically, with this linked arrangement each vending machine is normally built as a stand-alone unit, with its own transactional and selection systems, so that each vending machine can be used alone without having to rely on the operational components of the other vending machines.

SUMMARY

According to one aspect, a vending machine comprises a main unit, and a secondary unit separate from and operably connected to the main unit. The secondary unit includes a refrigerated enclosure for housing pre-packaged food products and an oven for selectively cooking the pre-packaged food products. The main unit includes a transfer mechanism adapted to selectively remove one of the pre-packed food products from the enclosure and transfer the one pre-packaged food product to the oven for cooking. The transfer mechanism is further adapted to remove the cooked one pre-packaged food product from the oven and transfer the cooked one pre-packaged food product to a customer receiving area provided in the main unit.

According to another aspect, a vending machine comprises a main unit, and a secondary unit separate from and operably connected to the main unit. The secondary unit includes a refrigerated enclosure for housing pre-packaged food products and an oven for selectively cooking the pre-packaged food products. A side wall of the enclosure includes a first door movable between a closed position and an opened position to provide access into the enclosure, and the oven includes a second door movable between a closed position and an opened position to provide access into the oven. The main unit includes a transfer mechanism to selectively remove one of the pre-packed food products from the enclosure and transfer the one pre-packaged food product to the oven for cooking. The transfer of the one pre-packed food product from the enclosure to the oven is entirely through the main unit.

DETAILED DESCRIPTION

Figure 1:
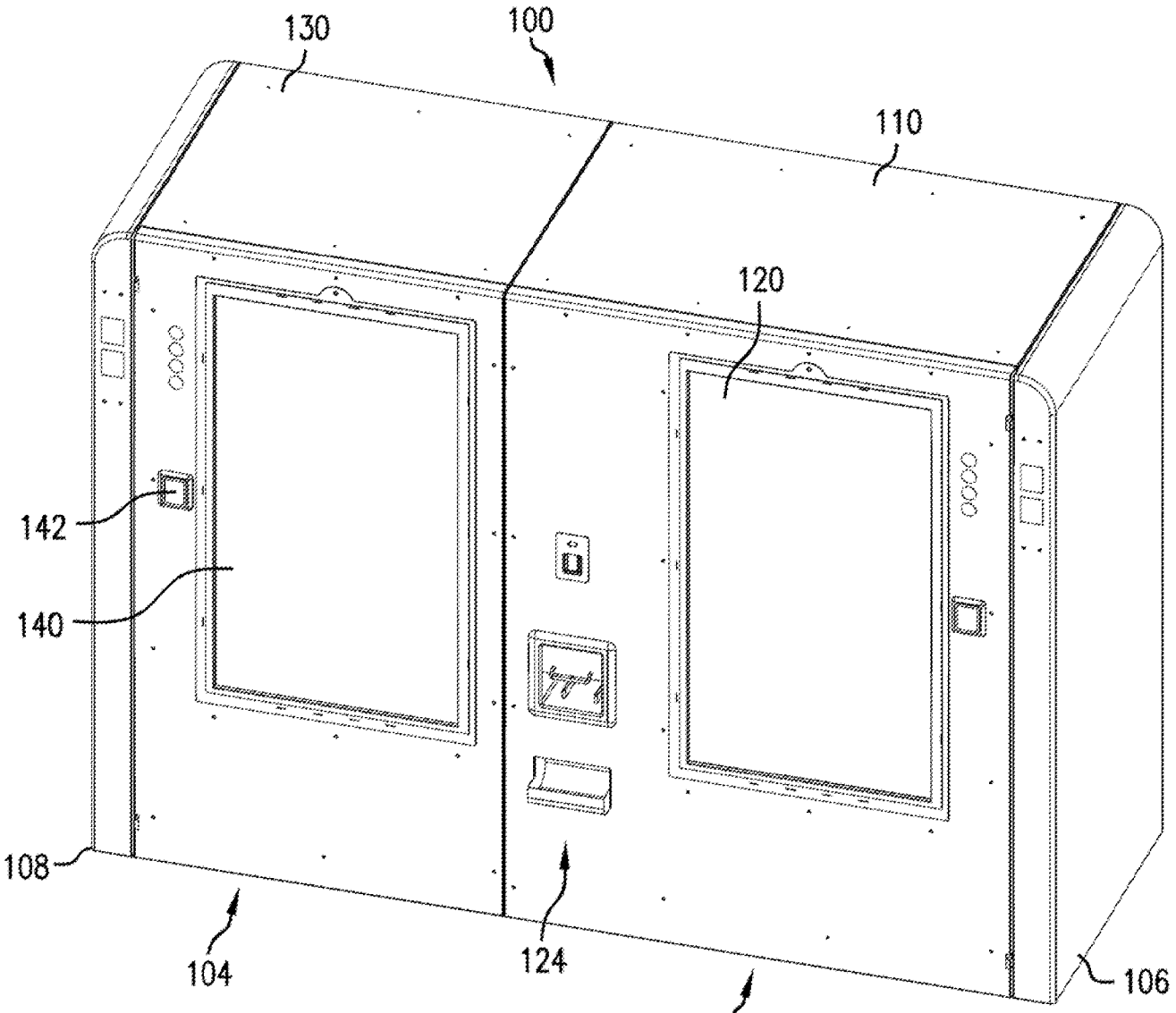
FIG. 1 is a perspective view of a vending machine according to the present disclosure including a main unit and a secondary unit releasably connected to the main unit.

It should, of course, be understood that the description and drawings herein are merely illustrative and that various modifications and changes can be made in the structures disclosed without departing from the present disclosure. Referring now to the drawings, wherein like numerals refer to like parts throughout the several views, FIG. 1 depicts a vending machine 100 according to the present disclosure. The term "vending machine" is used to denote any type of machine that stores products for remote distribution or sale to consumers wherein the consumer transacts business with the machine. The vending machine 100 includes a main unit 102 and a secondary unit 104 separate from and operably connected to the main unit. A first removable end cap 106 is mounted to a side of the main unit 102 opposite the secondary unit 104, and a second removable end cap 108 is mounted to a side of the secondary unit 104 opposite the main unit 102. It should be appreciated that the removable end caps allow for additional secondary units to be operably connected to the main unit 102. The main unit 102 generally includes a cabinet or housing 110 for housing various operational components of the main unit 102. The operational components can comprise a refrigerated enclosure 112 that includes refrigerated passages or compartments for storing pre-packaged food products to be dispensed, an oven (not visible) mounted atop the refrigerated enclosure 112 for selectively heating/cooking the pre-packed food products, and a transfer mechanism 116 adapted to selectively remove one of the pre-packed food products from the enclosure 112 and transfer the food product to the oven for cooking. The oven can be a number of different types of ovens, including microwave, radio frequency, infrared, convection, resistive element and combinations of these types. The transfer mechanism 116 is further adapted to remove the heated/cooked food product from the oven and transfer the heated/cooked food product to the customer receiving area 124.

Figure 2:
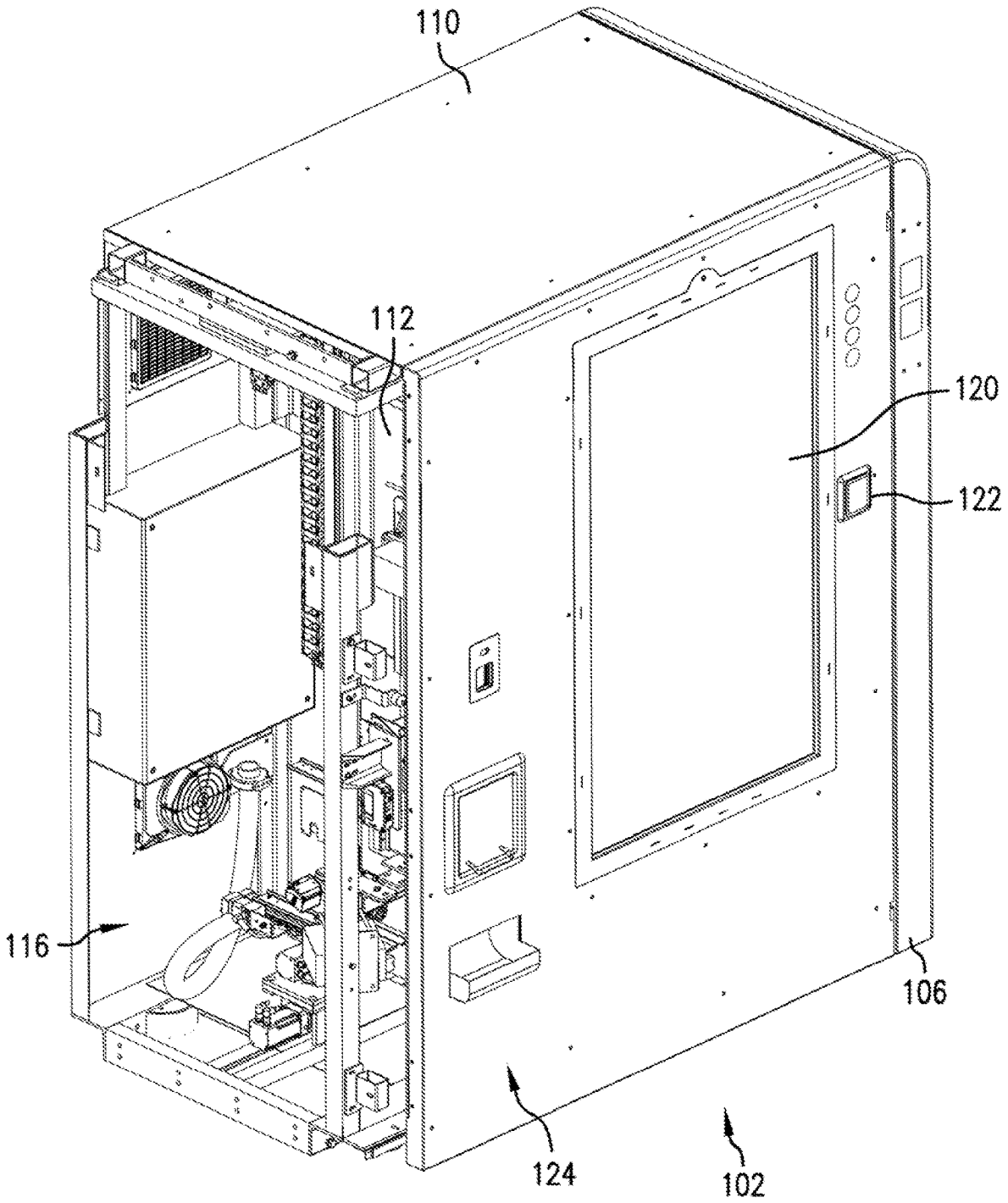
FIGS. 2 and 3 are respective perspective views of the main unit and the secondary unit.

As depicted in FIGS. 1 and 2, the exemplary main unit 102 of the vending machine 100 includes a front operational panel 120, which can include a display/touch screen, a credit/debit card reader 122, and a customer receiving area 124 for receipt of the heated/cooked food product. The operational panel 120 and card reader 122 are electronically coupled with a central processing unit (CPU) (not shown) for automated operation of the vending machine 100. The depictions of the pre-packaged food products available for selection/purchase from the main unit 102 optionally are viewable on the operational panel 120 and can be selected, for example, by entering a code on a keypad depicted on the operational panel 120. The CPU can include a processing module configured to verify receipt of payment for the selected food product, generate a transfer signal for the transfer mechanism 116 to retrieve the selected food product from the enclosure 112 and deliver the selected food product to the oven, generate a cooking signal that selectively operates the oven based on the selected food product, and generate a dispensing signal for the transfer mechanism 116 to retrieve the heated/cooked food product from the oven and deliver the heated/cooked food product to the customer receiving area 124.

Figure 3:
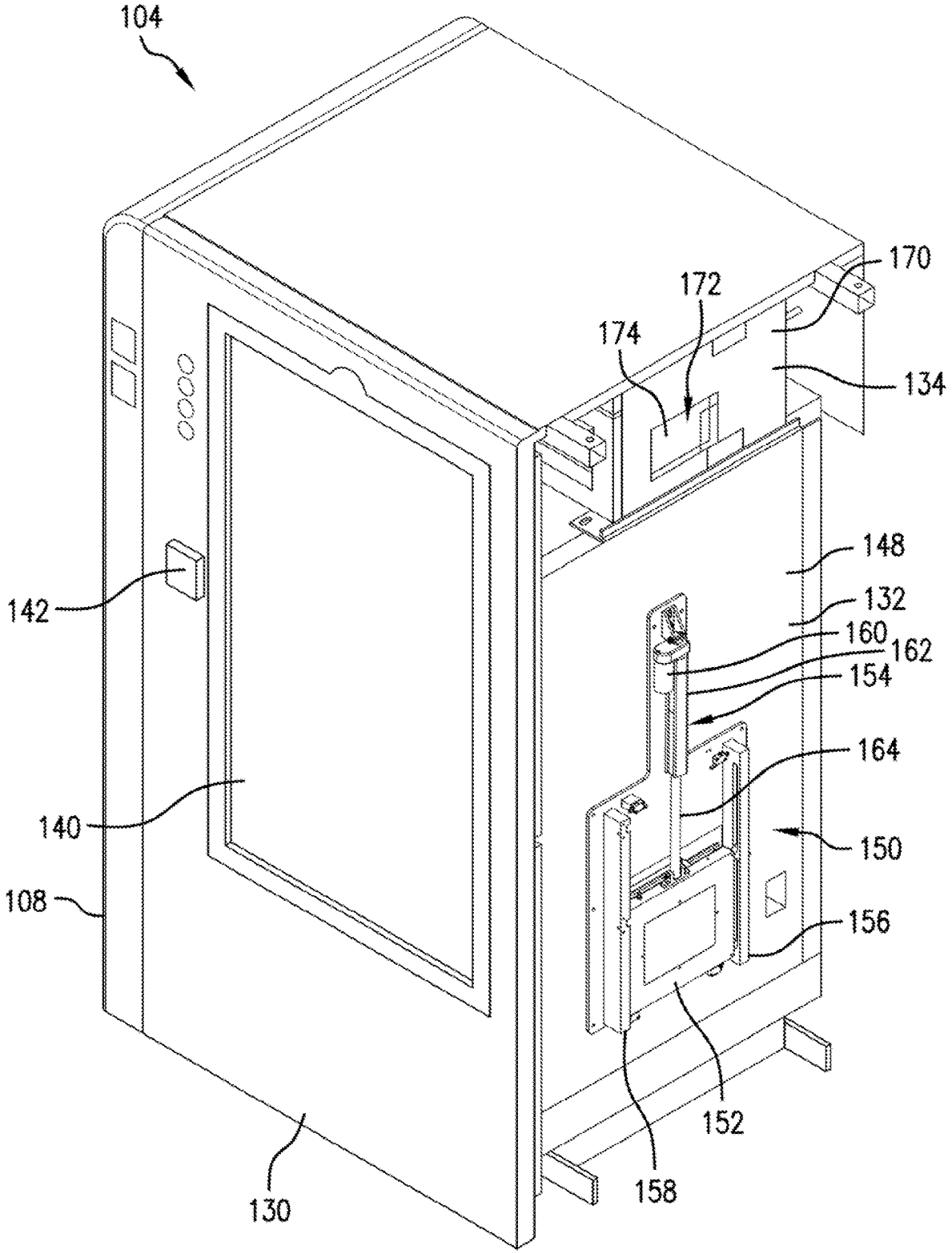

As depicted in FIGS. 1 and 3, the exemplary secondary unit 104 includes a cabinet or housing 130 for housing various operational components of the secondary unit. The operational components can comprise a refrigerated enclosure 132 that includes refrigerated passages or compartments for storing pre-packaged food products to be dispensed and an oven 134 mounted atop the refrigerated enclosure 132 for selectively heating/cooking the food product. Again, the oven 134 can be a number of different types of ovens, including microwave, radio frequency, infrared, convection, resistive element and combinations of these types. According to the present embodiment, the secondary unit 104 is devoid of another transfer mechanism to selectively remove the food product from the enclosure 132 and transfer the food product to the oven 134 for cooking. Therefore, according to the present disclosure, the transfer mechanism 116 of the main unit 102 is adapted to selectively remove one of the food products from the enclosure 132 and transfer the food product to the oven 134 for cooking. Because the illustrated secondary unit 104 is also devoid of another customer receiving area, the transfer mechanism 116 of the main unit 102 is further adapted to remove the heated/cooked food product from the oven 134 and transfer the heated/cooked food product to the customer receiving area 124 of the main unit 102. Therefore, for the vending machine 100, the main unit 102 solely vends the heated/cooked pre-packaged food product from both the main unit 102 and the secondary unit 104 to an associated customer.

As depicted, the secondary unit 104 of the vending machine 100 includes a front operational panel 140, which can include a display/touch screen, and optionally a credit/debit card reader 142. The operational panel 140 and optional card reader 142 are electronically coupled with the CPU of the main unit 102. Similar to the main unit 102, depictions of the food products available for selection/purchase from the secondary unit 104 optionally are viewable on the operational panel 140 and can be selected, for example, by entering a code on a keypad depicted the operational panel 140. The CPU of the main unit 102 can include a secondary processing module configured to verify receipt of payment for the selected food product, generate a secondary transfer signal for the transfer mechanism 116 to retrieve the selected food product from the enclosure 132 and deliver the selected food product to the oven 134, generate a cooking signal that selectively operates the oven 134 based on the selected food product, and generate a dispensing signal for the transfer mechanism 116 to retrieve the heated/cooked food product from the oven 134 and deliver the heated/cooked food product to the customer receiving area 124 of the main unit 102.

According to the present disclosure, the transfer of the pre-packed food product from the enclosure 132 to the oven 134 via the transfer mechanism 116 is through the main unit 102, and more particularly, entirely through the main unit 102. To this end, the enclosure 132 includes a side wall 148 exposed to the transfer mechanism 116. A first door assembly 150 is mounted to the side wall 148. In the depicted embodiment, the first door assembly includes a first door 152 and an actuator 154 operably coupled to the first door 152 to selectively move the first door between a closed position and an opened position to provide access into the enclosure 132. The first door 152 can be guided, for example, in a pair of guide tracks 156, 158 mounted to the side wall 148 and is movable in the guide tracks 156, 158 in a height direction of the secondary unit 104. Although, it should be appreciated that the guide tracks 156, 158 can be arranged so that the first door 152 is movable in a width direction of the secondary unit. In the depicted aspect, the actuator 154 includes a motor 160, a threaded sleeve 162, and a threaded rod 164. The threaded rod 164 has a first end portion received in the threaded sleeve 162 and coupled to the motor 160 and a second end portion coupled to the first door 152. With the depicted arrangement, rotation of the threaded rod 164 within the threaded sleeve 162 causes corresponding vertical movement of the first door 152. It should be appreciated that alternative configurations for the actuator 154 are contemplated.

The oven 134 includes a side wall 170 exposed to the transfer mechanism 116. A second door assembly 172 is mounted to the side wall 170. The second door assembly includes a second door 174 and an actuator (not visible) operably coupled to the second door 174 to selectively move the second door between a closed position and an opened position to provide access into the oven 134. As shown in FIG. 3, the second door 174 is aligned with the first door 152 in the height direction of the secondary unit 104, which allows for ease of the transfer mechanism 116 to move the selected food product from the enclosure 132 to the oven 134.

Figure 4:
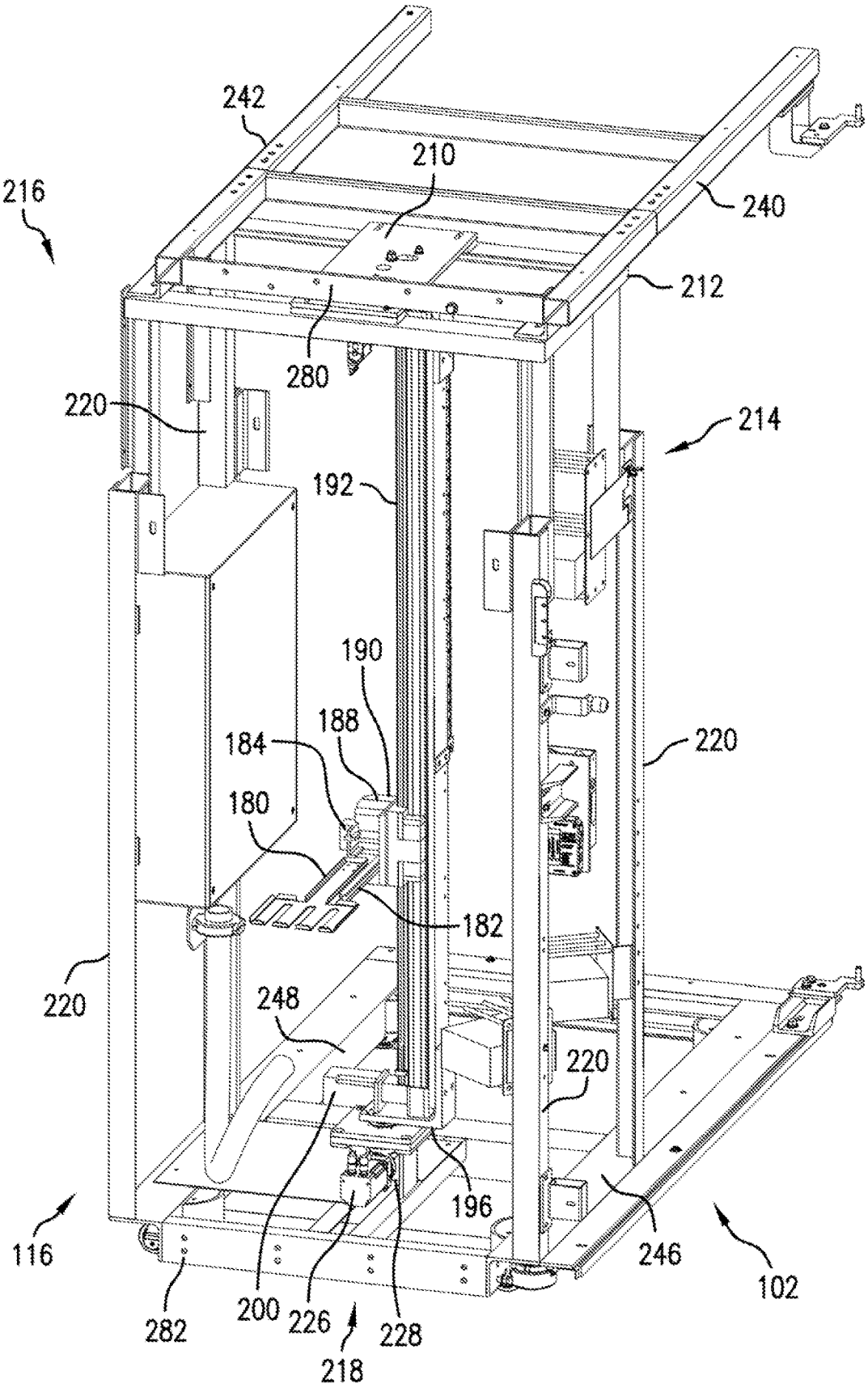
FIG. 4 is a perspective view of a transfer mechanism and frame structure of the main unit.
Figure 5:
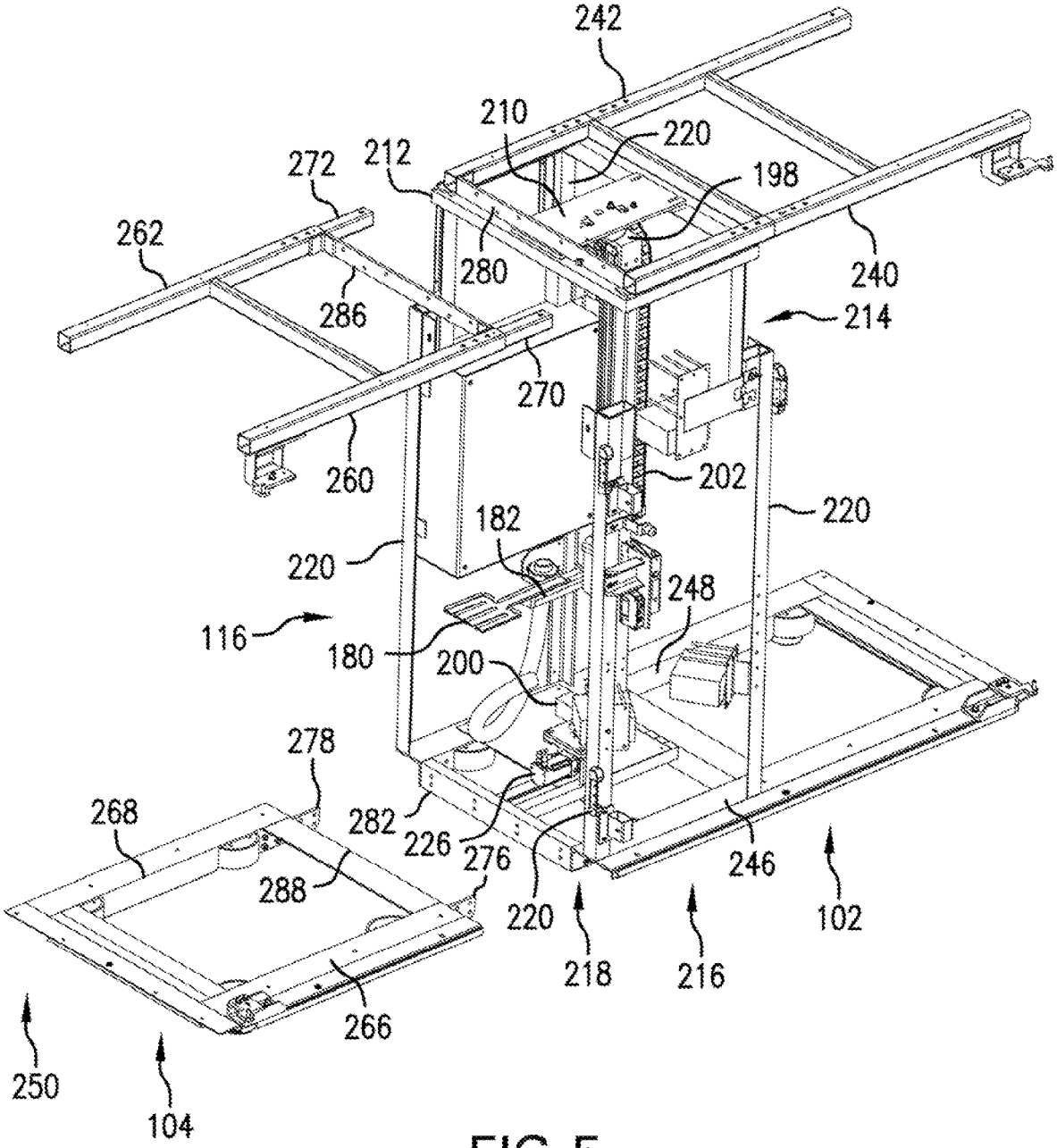
FIGS. 5 and 6 are perspective views of FIG. 4 together with a frame structure of the secondary unit.
Figure 6:
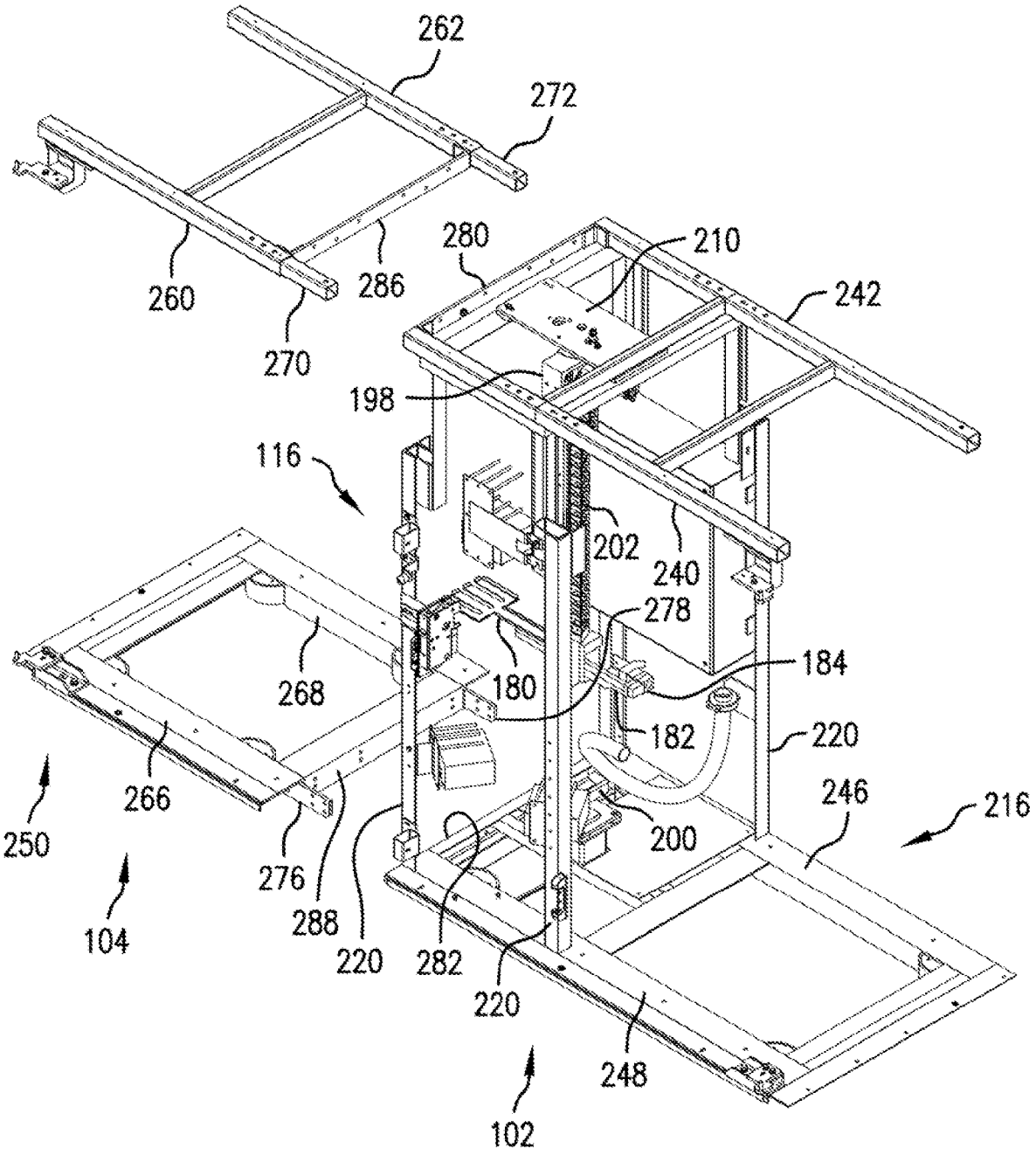

FIGS. 4-6 depict an aspect of the transfer mechanism 116 according to the present disclosure. The transfer mechanism 116 includes a transport or arm 180 movable on a guide rail 182 along a height direction of the main unit 102 and extendable in a length direction of the main unit 102 toward the secondary unit 104. The arm 180 is adapted to move into both the enclosure 132 and the oven 134. A first actuator or motor 184 is mounted to the guide rail 182 and is adapted to move the arm 180 along the guide rail 182. The guide rail 182 is mounted to a bracket 188 which is connected to a carriage 190. The carriage 190 is movable on a vertical guide 192, having a lower end portion connected to a lower support 196 and an upper end portion connected to an upper support 198. A second actuator or motor 200 is mounted to the lower support 196 and is adapted to move the carriage 190 along the vertical guide 192 via, for example, a link or chain 202 connected to the carriage 190. According to one aspect, the vertical guide 192 is rotatable to move the arm 180 toward and away from the secondary unit 104. The upper support 198 is rotatably connected to a support plate 210. The support plate 210 is affixed to an upper frame part 212 of a sub-frame structure 214 that supports the transfer mechanism 116. The sub-frame structure 214, which is part of a main frame structure 216 of the main unit 102, includes the upper frame part 212, a lower frame part 218, and vertical frame members 220 interconnecting the upper and lower frame parts 212, 218. A third actuator or motor 226 is mounted to the lower frame part 218, and a rotary gear box 228 has its input operably coupled to the third motor 226 and its output connected to the lower support 196. Accordingly, the third motor 226 rotates the lower support 196, and the vertical guide 192 connected thereto, via the rotary gear box 228.

FIGS. 5 and 6 depict one arrangement by which the secondary unit 104 is releasably connected to the main unit 102. The main frame structure 216 of the main unit 102 includes upper frame rails 240, 242 and lower frame rail 246, 248. The upper frame rails 240, 242, which can be formed of square tube, are fixed to the upper frame part 212. The lower frame rails 246, 248, which can be L-shaped, are fixed to the lower frame part 218. The secondary unit 104 includes a secondary frame structure 250. According to the depicted aspect, the secondary frame structure 250 includes upper frame rails 260, 262, which can be formed of square tube, and lower frame rails 266, 268, which can be L-shaped. Extensions 270, 272 provided on the upper frame rails 260, 262 are sized to be received in and releasably secured to the upper frame rails 240, 242. Mounts 276, 278 provided on the lower frame rails 266, 268 are releasably secured to the lower frame rail 246, 248. Further, the main frame structure 216 can include an upper transverse support 280 interconnecting the upper frame rails 240, 242 and a lower transverse support 282 interconnecting the lower frame rails 246, 248. Similarly, the secondary frame structure 250 can include an upper transverse support 286 interconnecting the upper frame rails 260, 262 and a lower transverse support 288 interconnecting the lower frame rails 266, 268. To further secure the secondary unit 104 to the main unit 102, the upper transverse supports 280, 286 and the lower transverse supports 282, 288 can be connected.

In use, an associated customer selects a pre-packaged food product for purchase via, for example, the operational panel 140 provided on the secondary unit 104. Once payment is verified by the CPU of the main unit 102, the transfer mechanism 116 rotates and properly aligns the arm 180 with the first door 152 located on the refrigerated enclosure 132. It should be appreciated that housed in the enclosure 132 is a product conveying system which moves the selected food product from its storage compartment to a location in the enclosure 132 for pickup by the arm 180. The actuator 154 moves the first door 152 to its opened position and the arm 180 is then extended into the enclosure 132. Again, movement of the arm 180 is along the guide rail 182 via operation of the first motor 184. The arm 180 together with the selected food package is then moved out of the enclosure 132 into the main unit 102, and the first door 152 is moved back to its closed position. The second motor 200 is actuated, moving the carriage 190 along the vertical guide 192 to a position where the arm 180 is aligned with the second door 174 of the oven 134. The second door 174 is raised to its opened position, the arm 180 is extended to place the selected food product in the oven 134 for heating/cooking, the arm 180 is retraced, and the second door 174 is moved back to its closed position. After heating/cooking, the second door 174 is raised to its opened position, the arm 180 is extended to remove heated/cooked food product, the arm 180 together with the heated/cooked food product is retracted back into the main unit 102, and the second door 174 is moved back to its closed position. The vertical guide 192 is rotated via actuation of the third motor 226, the carriage 190 is moved along the vertical guide 192 via actuation of the second motor 200 to a position where the transfer mechanism 116 can place the heated/cooked food product in the customer receiving area 124 for pickup by the customer.

It will be appreciated that various of the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A vending machine comprising:

a main unit;

a secondary unit separate from and operably connected to the main unit, wherein:

the secondary unit includes a refrigerated enclosure for housing pre-packaged food products and an oven for selectively cooking the pre-packaged food products, and the main unit includes a transfer mechanism adapted to selectively remove one of the pre-packed food products from the enclosure and transfer the one pre-packaged food product to the oven for cooking, the transfer mechanism further adapted to remove the cooked one pre-packaged food product from the oven and transfer the cooked one pre-packaged food product to a customer receiving area provided in the main unit.

2. The vending machine of claim 1, wherein the transfer of the one pre-packed food product from the enclosure to the oven is through the main unit.

3. The vending machine of claim 2, wherein the enclosure includes a side wall exposed to the transfer mechanism.

4. The vending machine of claim 3, wherein the side wall of the enclosure includes a first door movable between a closed position and an opened position to provide access into the enclosure, and the transfer mechanism includes an arm adapted to move into the enclosure.

5. The vending machine of claim 4, wherein the first door is guided in a guide track mounted to the side wall, and further including an actuator mounted to the side wall and operably coupled to the first door, the actuator configured to move the first door between the closed position and the opened position.

6. The vending machine of claim 5, wherein the first door is movable in the guide track in a height direction of the secondary unit.

7. The vending machine of claim 4, wherein the oven includes a second door movable between a closed position and an opened position to provide access into the oven, and the arm of the transfer mechanism is adapted to move into the oven.

8. The vending machine of claim 7, wherein the second door is aligned with the first door in a height direction of the secondary unit.

9. The vending machine of claim 1, wherein a main frame structure of the main unit is releasably connected to a secondary frame structure of the secondary unit.

10. The vending machine of claim 9, wherein the main frame structure includes a sub-frame structure for supporting the transfer mechanism, and the secondary frame structure includes a pair of upper frame rails connected to an upper part of the sub-frame structure.

11. The vending machine of claim 10, wherein the secondary frame structure includes a pair of mounts connected to a lower part of the sub-frame structure.

12. The vending machine of claim 1, wherein the oven is supported on an upper surface of the enclosure.

13. The vending machine of claim 1, wherein the secondary unit is devoid of another transfer mechanism to selectively remove the one pre-packed food product from the enclosure and transfer the one pre-packaged food product to the oven for cooking, and the secondary unit is devoid of another customer receiving area, the main unit solely vending the cooked one pre-packaged food product to an associated customer.

14. The vending machine of claim 1, wherein the transfer mechanism includes an arm movable along a guide rail in a height direction of the main unit and extendable in a length direction of the main unit toward the secondary unit.

15. The vending machine of claim 1, further including a first removable end cap mounted to a side of the main unit opposite the secondary unit, and a second removable end cap mounted to a side of the secondary unit opposite the main unit.

16. A vending machine comprising:

a main unit;

a secondary unit separate from and operably connected to the main unit, wherein:

the secondary unit includes a refrigerated enclosure for housing pre-packaged food products and an oven for selectively cooking the pre-packaged food products, a side wall of the enclosure includes a first door movable between a closed position and an opened position to provide access into the enclosure, and the oven includes a second door movable between a closed position and an opened position to provide access into the oven, and the main unit includes a transfer mechanism to selectively remove one of the pre-packed food products from the enclosure and transfer the one pre-packaged food product to the oven for cooking, and the transfer of the one pre-packed food product from the enclosure to the oven is entirely through the main unit.

17. The vending machine of claim 16, wherein the transfer mechanism is adapted to remove the cooked one pre-packaged food product from the oven and transfer the cooked one pre-packaged food product to a customer receiving area provided in the main unit.

18. The vending machine of claim 16, wherein a main frame structure of the main unit is releasably connected to a secondary frame structure of the secondary unit.

* * * * *